US012487035B2

(12) United States Patent
Negi et al.

(10) Patent No.: US 12,487,035 B2
(45) Date of Patent: Dec. 2, 2025

(54) HEAT EXCHANGER

(71) Applicant: RINNAI CORPORATION, Aichi (JP)

(72) Inventors: Hidenao Negi, Aichi (JP); Toshimitsu Nagasaka, Aichi (JP)

(73) Assignee: RINNAI CORPORATION, Aichi (JP)

( * ) Notice: Subject to any disclaimer, the term of this patent is extended or adjusted under 35 U.S.C. 154(b) by 126 days.

(21) Appl. No.: 18/529,762

(22) Filed: Dec. 5, 2023

(65) Prior Publication Data

US 2024/0271885 A1 Aug. 15, 2024

(30) Foreign Application Priority Data

Feb. 15, 2023 (JP) ..... 2023-021745

(51) Int. Cl.
*F28F 1/32* (2006.01)
*F24H 1/14* (2022.01)
(Continued)

(52) U.S. Cl.
CPC ..... *F28F 1/325* (2013.01); *F24H 1/14* (2013.01); *F24H 1/41* (2013.01); *F28D 21/0003* (2013.01); *F28F 2215/04* (2013.01)

(58) Field of Classification Search
CPC ... F24H 1/40; F24H 1/403; F24H 1/41; F24H 1/14; F24H 1/145; F24H 1/107;
(Continued)

(56) References Cited

U.S. PATENT DOCUMENTS 3,534,712 A * 10/1970 Reynolds ..... F24H 1/38 122/225 R
2014/0174382 A1* 6/2014 Oohigashi ..... F24H 8/00 165/157

(Continued)

FOREIGN PATENT DOCUMENTS

JP 2005156033 A * 6/2005
JP 2014-137208 A 7/2014

*Primary Examiner* — Jianying C Atkisson
*Assistant Examiner* — For K Ling
(74) *Attorney, Agent, or Firm* — Future IP LLC; Tomoko Nakajima

(57) ABSTRACT

In a heat exchanger, a respective meander passage $\mathbf{3}_1$, $\mathbf{3}_2$ in each of two stages connecting heat absorbing tubes 31 divided into the two stages and arranged in a flow direction of a combustion gas in an inside of a casing 1 from one side to the other side in a Y-axis direction is constituted, and both a heat absorbing tube 31 of #11 at an upstream end of the meander passage $\mathbf{3}_1$ in a first stage and a heat absorbing tube 31 of #21 at a downstream end of the meander passage $\mathbf{3}_2$ in a second stage are made to be positioned at the one side in the Y-axis direction, notches are provided with each heat absorbing fin 2 at portions positioned at a more upstream side in the flow direction of the combustion gas than each heat absorbing tube 31 of the meander passage $\mathbf{3}_2$ in the second stage, and first notches $\mathbf{22}_1$ corresponding to the heat absorbing tube 31 at a downstream end of the meander passage $\mathbf{3}_2$ in the second passage are formed larger than second notches $\mathbf{22}_2$ corresponding to each heat absorbing tube 31 other than the heat absorbing tube 31 of #21 at the downstream end.

5 Claims, 6 Drawing Sheets

(51) Int. Cl.
*F24H 1/41* (2022.01)
*F28D 21/00* (2006.01)

(58) Field of Classification Search
CPC .... F24H 1/16; F24H 1/165; F24H 1/43; F28F 1/32; F28F 1/325; F28F 1/30; F28F 2215/04; F28F 2215/08
See application file for complete search history.

(56) References Cited

U.S. PATENT DOCUMENTS

| | | | | |
|---|---|---|---|---|
| 2014/0345542 | A1* | 11/2014 | Ishkado | F24H 1/40 122/18.4 |
| 2017/0184349 | A1* | 6/2017 | Ooshita | F28F 1/325 |
| 2018/0106498 | A1* | 4/2018 | Nishino | F24H 1/40 |
| 2018/0306529 | A1* | 10/2018 | Kasamatsu | F28F 1/32 |
| 2019/0154300 | A1* | 5/2019 | Kondo | F28D 7/16 |
| 2020/0033071 | A1* | 1/2020 | Kondo | F28D 1/0472 |

* cited by examiner

HEAT EXCHANGER

TECHNICAL FIELD

The invention relates to a heat exchanger heated by a combustion gas, which includes a rectangular cylindrical casing an inside of which the combustion gas flows in, on a premise that two orthogonal directions crossing a flow direction of the combustion gas in the casing are defined as an X-axis direction and a Y-axis direction, respectively, a plurality of heat absorbing fins stacked and arranged in the X-axis direction in the casing, a plurality of heat absorbing tubes piercing through the heat absorbing fins and side plates of both sides in the X-axis direction of the casing, and an inside of which a fluid to be heated flows in, and a connecting portion connecting the heat absorbing tubes in series at outsides of the side plates of both sides in the X-axis direction of the casing.

BACKGROUND ART

Conventionally, in such a heat exchanger of this kind, there has been known the heat exchanger in which the heat absorbing tubes are divided into two stages and arranged in the flow direction of the combustion gas, a meander passage connecting a plurality of the heat absorbing tubes in each stage from an outermost side of one side in the Y-axis direction to an outermost side of the other side in the Y-axis direction is constituted by a plurality of the heat absorbing tubes of each stage and the connecting portion for each stage, and one of the stages in which the meander passage is provided and which is positioned at an upstream side in the flow direction of the combustion gas is defined as a first stage and the other of the stages in which the meander passage is provided and which is positioned at a downstream side in the flow direction of the combustion gas is defined as a second stage (Patent document No. 1, for example). In the heat exchanger, the heat absorbing tubes at upstream and downstream ends of the meander passage in the first stage are made to be positioned at the outermost side of the one side in the Y-axis direction and at the outermost side of the other side in the Y-axis direction, respectively. Then, the heat absorbing tube at the downstream end in the first stage and the heat absorbing tube at the upstream end, which is positioned at the outermost side of the other side in the Y-axis direction, of the meander passage in the second stage are connected to each other, allowing the fluid to be heated to flow from the meander passage in the first stage to the meander passage in the second passage.

REFERENCE

Patent document No. 1: JP2014-137208 A

SUMMARY OF INVENTION

Technical Problem

Here, when the heat absorbing tubes thermally expand in the X-axis direction as a longitudinal direction thereof, the side plates of each side in the X-axis direction of the casing, through which the heat absorbing tubes pierce and on which the heat absorbing tubes are brazed, are pressed in the X-axis direction. In the above conventional heat exchanger, the heat absorbing tube (the heat absorbing tube in which the cold fluid to be heated flows) at the upstream end of the meander passage in the first stage and the heat absorbing tube (the heat absorbing tube from which the heated fluid is discharged) at the downstream end of the meander passage in the second stage are positioned at the outermost side of the one side in the Y-axis direction, respectively, and come close to each other. Temperature difference between these heat absorbing tubes is the largest among those between any one of the heat absorbing tubes of the meander passage in the first stage and any one of the heat absorbing tubes of the meander passage in the second stage. Therefore, due to the difference in the amount of thermal expansion in such two heat absorbing tubes, a large stress is applied to the side plates of each side in the X-axis direction of the casing. Then, cracks appear in the side plates due to repetition of the stress applied to the side plates.

In the light of the above problem, the invention provides a heat exchanger of which durability is improved by reducing the stress acting on the side plates of each side in the X-axis direction of the casing.

Solution to Problem

In order to solve the above problem, the invention presupposes a heat exchanger heated by a combustion gas, which includes a rectangular cylindrical casing an inside of which the combustion gas flows in; on a premise that two orthogonal directions crossing a flow direction of the combustion gas in the casing are defined as an X-axis direction and a Y-axis direction, respectively; a plurality of heat absorbing fins stacked and arranged in the X-axis direction in the casing; a plurality of heat absorbing tubes piercing through the heat absorbing fins and side plates of both sides in the X-axis direction of the casing, and an inside of which a fluid to be heated flows in; and a connecting portion connecting the heat absorbing tubes in series at outsides of the side plates of both sides in the X-axis direction of the casing, wherein the heat absorbing tubes are divided into two stages and arranged in the flow direction of the combustion gas, a meander passage connecting a plurality of the heat absorbing tubes in each stage from an outermost side of one side in the Y-axis direction to an outermost side of the other side in the Y-axis direction is constituted by a plurality of the heat absorbing tubes in each stage and the connecting portion for each stage, the meander passage is provided in a first stage of an upstream side in the flow direction of the combustion gas and the meander passage is provided in a second stage of a downstream side in the flow direction of the combustion gas, the heat absorbing tube at an upstream end and the heat absorbing tube at a downstream end of the meander passage in the first stage are positioned at the outermost side of the one side in the Y-axis direction and at the outermost side of the other side in the Y-axis direction, respectively, and the heat absorbing tube at the downstream end of the meander passage in the first stage and the heat absorbing tube at the upstream end, which is positioned at the outermost side of the other side in the Y-axis direction, of the meander passage in the second passage are connected, allowing the fluid to be heated to flow from the meander passage in the first stage to the meander passage in the second stage. In the heat exchanger, notches are provided with each heat absorbing fin at portions positioned at a more upstream side in the flow direction of the combustion gas than each heat absorbing tube of the meander passage in the second stage, the notches corresponding to the heat absorbing tube at the downstream end, which is positioned at the outermost side of the one side in the Y-axis direction of the meander passage in the second stage, are defined as first notches, the notches corresponding to each heat absorbing tube other than the heat absorbing tube at the downstream end of the meander passage in the second stage are defined as second notches, and the first notches are formed larger than the second notches.

According to the invention, heat transfer to the heat absorbing tube at the downstream end of the meander passage in the second passage, of which temperature becomes the highest, through each heat absorbing fin can be reduced by the larger first notches. Therefore, temperature difference between the heat absorbing tube at the upstream end of the meander passage in the first stage and the heat absorbing tube at the downstream end of the meander passage in the second stage is made to decrease, a stress acting on the slide plates of each side in the X-axis direction of the casing can be reduced, and durability can be improved.

In addition, in the invention, it is desirable that a width of a portion of each heat absorbing fin between the heat absorbing tube at the upstream end of the meander passage in the first stage and the first notch is wider than widths of portions of each heat absorbing fin between each second notch and such each heat absorbing tube other than the heat absorbing tube at the upstream end of the meander passage in the first stage as is adjacent to each second notch at the upstream side in the flow direction of the combustion gas. According to this, heat transfer to the heat absorbing tube at the upstream end of the meander passage in the first stage through each heat absorbing tube is promoted, and temperature of the combustion gas directed to the heat absorbing tube at the downstream end of the meander passage in the second stage, which is positioned at the downstream side in the flow direction of the combustion gas with respect to such heat absorbing tube of the meander passage in the first stage, is lowered. As a result, the temperature difference between the heat absorbing tube at the upstream end of the meander passage in the first stage and the heat absorbing tube at the downstream end of the meander passage in the second stage is made to decrease more, and the stress acting on the side plates of each side in the X-axis direction of the casing can be reduced.

Further, in the invention, it is desirable that a distance between the heat absorbing tube at the upstream end positioned at the outermost side of the one side in the Y-axis direction of the meander passage in the first stage and the heat absorbing tube at the downstream end positioned at the outermost side of the one side in the Y-axis direction of the meander passage in the second stage is longer than a respective distance between each heat absorbing tube other than the heat absorbing tube at the upstream end of the meander passage in the first stage and such each heat absorbing tube other than the heat absorbing tube at the downstream end of the meander passage in the second stage as is the closest to each heat absorbing tube other than the heat absorbing tube at the upstream end of the meander passage in the first stage. Thus, the stress acting on the side plates of each side in the X-axis direction of the casing can be reduced by lengthening the distance between the heat absorbing tube at the upstream end of the meander passage in the first stage and the heat absorbing tube at the downstream end of the meander passage in the second stage, between which the temperature difference becomes largest.

In addition, in the invention, it is desirable that a ventilation resistant portion which suppresses the combustion gas from being directed to the heat absorbing tube at the downstream end of the meander passage in the second stage is provided. According to this, it is difficult for the combustion gas to flow around the heat absorbing tube, of which temperature is the highest, at the downstream end of the meander passage in the second stage, and heat transfer from the combustion gas to such heat absorbing tube can be reduced. Therefore, the temperature difference between the heat absorbing tube at the upstream end of the meander passage in the first stage and the heat absorbing tube at the downstream end of the meander passage in the second stage is made to decrease more, and the stress acting on the side plates of each side in the X-axis direction of the casing can be reduced.

Further, in the invention, in a case where an exhaust gas gathering portion covering an opening at the downstream end in the flow direction of the combustion gas of the casing is provided, and an exhaust port for discharging the combustion gas is opened at the exhaust gas gathering portion, it is desirable that the exhaust port is provided at a deviated portion of the other side in the Y-axis direction of the exhaust gas gathering portion. According to this, the combustion gas does not gather in the vicinity of the heat absorbing tube, of which temperature is the highest, at the downstream end of the meander passage in the second stage, and the heat transfer from the combustion gas to such heat absorbing tube can be reduced. Therefore, the temperature difference between the heat absorbing tube at the upstream end of the meander passage in the first stage and the heat absorbing tube at the downstream end of the meander passage in the second stage is made to decrease more, and the stress acting on the side plates of each side in the X-axis direction of the casing can be reduced.

DESCRIPTION OF EMBODIMENTS

Figure 1:
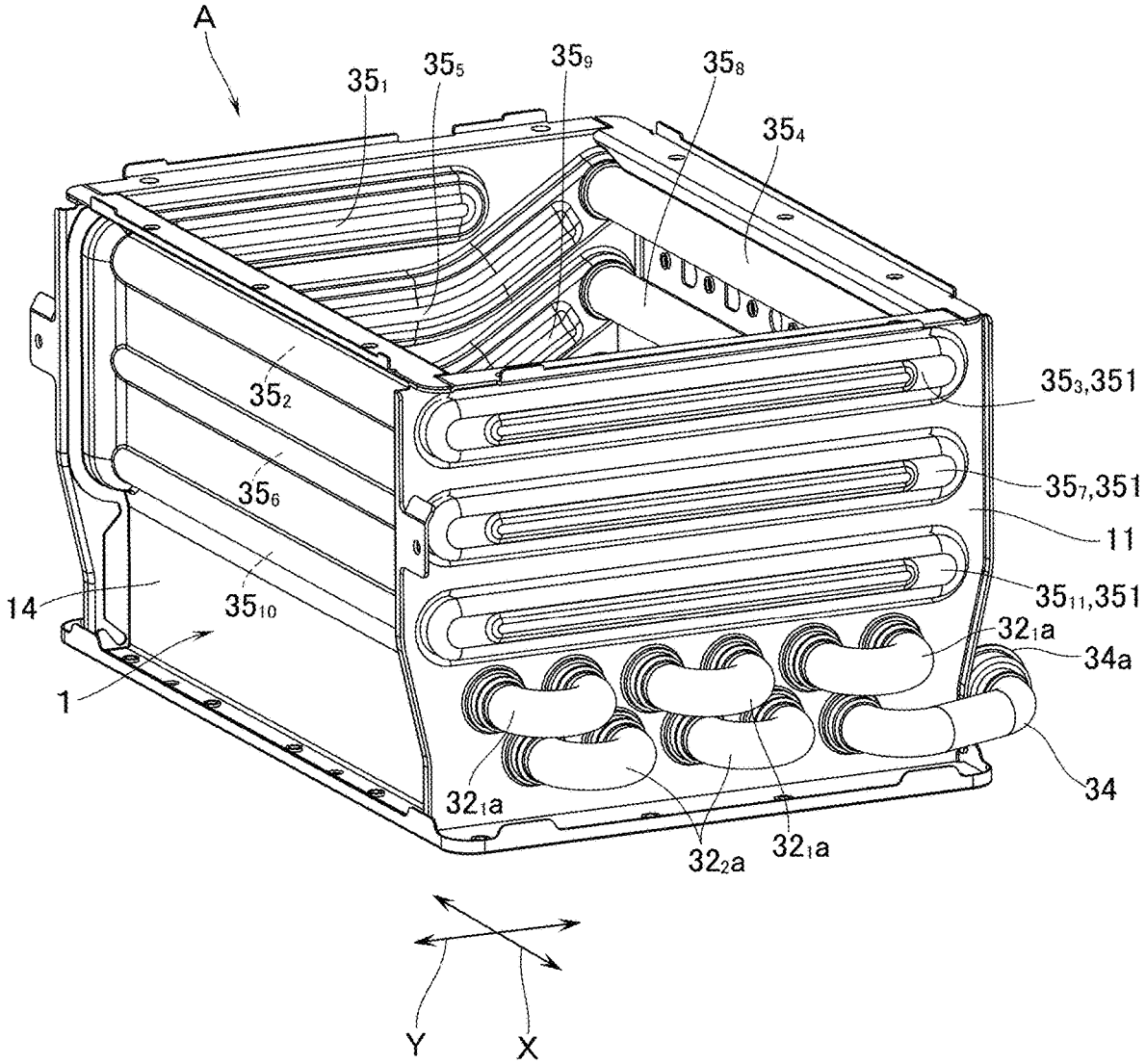
FIG. 1 is a perspective view of a heat exchanger of an embodiment of the invention.
Figure 2:
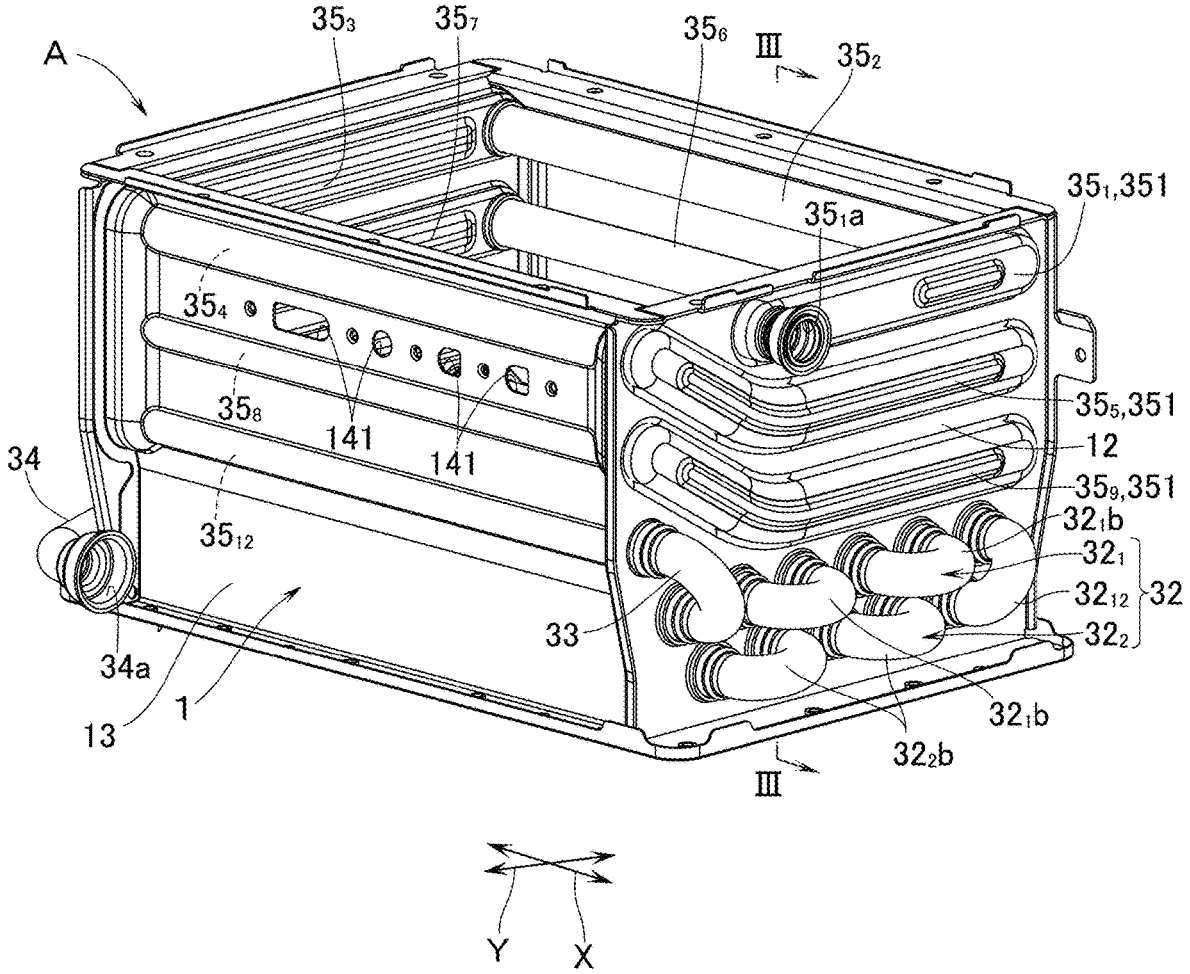
FIG. 2 is a perspective view of the heat exchanger of the embodiment, viewed from an opposite direction to FIG. 1.
Figure 3:
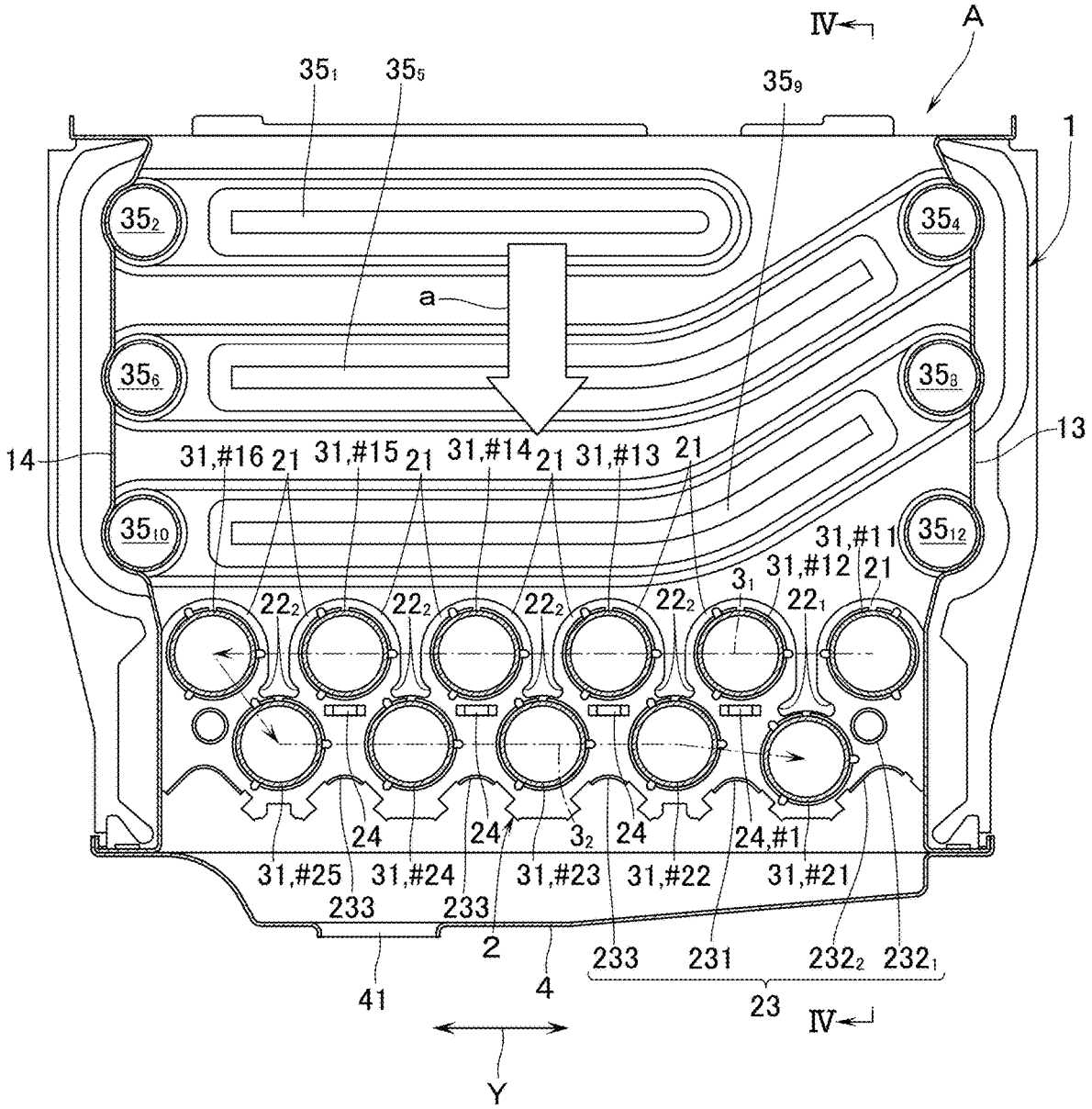
FIG. 3 is a section cut along a III-III line of FIG. 2.
Figure 4:
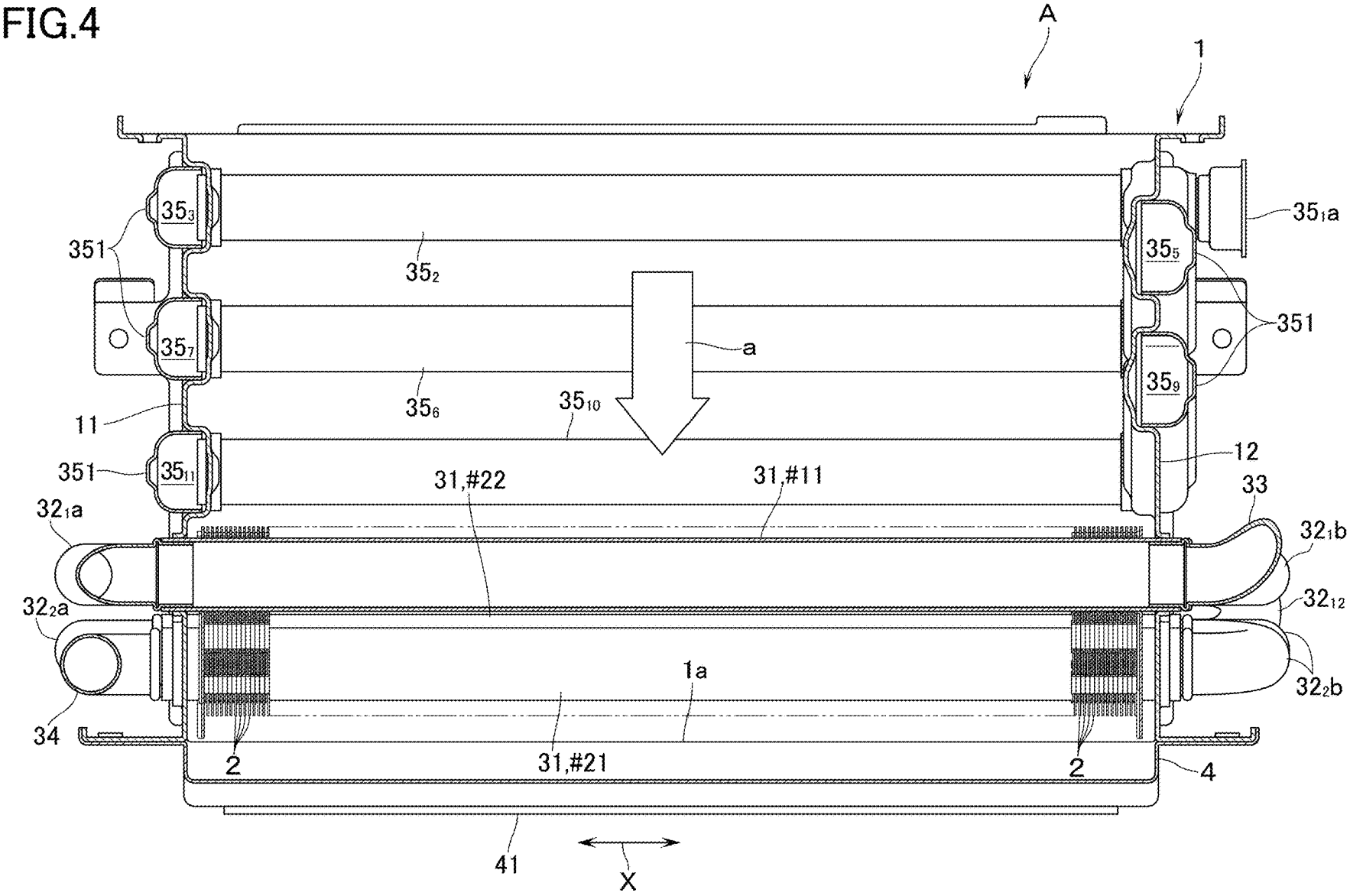
FIG. 4 is a cutaway side view cut along a IV-IV line.

Referring to FIGS. 1-4, a heat exchanger A of an embodiment of the invention includes a casing 1 having one end (an upper end in FIGS. 3, 4) on which a burner, not shown, is mounted. A combustion gas generated by combustion of an air-fuel mixture discharged from the burner flows in the casing 1, and the heat exchanger A is heated by the combustion gas. On a premise that two orthogonal directions crossing a flow direction of the combustion gas in the casing 1, which is shown by arrows "a" in FIGS. 3, 4, are defined as an X-axis direction and a Y-axis direction, respectively, the casing 1 has a rectangular cylindrical shape with side plates 11, 12 of both sides in the X-axis direction and side plates 13, 14 of both sides in the Y-axis direction. The heat exchanger A also includes a plurality of heat absorbing fins 2 stacked and arranged in the X-axis direction in the casing 1, a plurality of heat absorbing tubes 31 piercing through the heat absorbing fins 2 and the side plates 11, 12 of both sides in the X-axis direction of the casing 1, and into which a fluid to be heated such as water or the like flows, a connecting portion 32 connecting the heat absorbing tubes 31 in series at outsides of the side plates 11, 12 of both sides in the X-axis direction of the casing 1, and an exhaust gas gathering portion 4 covering an opening 1*a* at a downstream end (a lower end in FIGS. 3, 4) in the flow direction of the combustion gas of the casing 1 and having an exhaust port 41 opened for discharging the combustion gas. Meanwhile, the combustion gas discharged from the exhaust port 41 is introduced into a sub heat exchanger with latent heat recovery, which is not shown. In addition, each heat absorbing tube 31 is brazed on each heat absorbing fin 2 and each of the side plates 11, 12 in a piercing state.

The heat absorbing tubes 31, as specified in FIG. 3, are divided into two stages and arranged in the flow direction of the combustion gas. In particular, six heat absorbing tubes 31, i.e., #11-#16, from the heat absorbing tube 31 positioned at an outermost side of one side in the Y-axis direction to the heat absorbing tube 31 positioned at an outermost side of the other side in the Y-axis direction are arranged in a first stage which is a stage at an upstream side in the flow direction of the combustion gas, and five heat absorbing tubes 31, i.e., #21-#25 from the heat absorbing tube 31 positioned at the outermost side of the one side in the Y-axis direction to the heat absorbing tube 31 positioned at the outermost side of the other side in the Y-axis direction are arranged in a second stage which is a stage at a downstream side in the flow direction of the combustion gas. Each heat absorbing tube 31 in the second stage is arranged with a positional relationship such that a Y-axis direction center of such each heat absorbing tube 31 coincides with a Y-axis direction center between any two of the heat absorbing tubes 31, 31 adjacent to each other in the first stage. Meanwhile, each heat absorbing fin 2 is provided with each swelling portion 21 at a Y-axis direction position coincident with each heat absorbing tube 31 in the first stage, which swells to the upstream side in the flow direction of the combustion gas. Then, each heat absorbing tube 31 in the first stage pierces through each swelling portion 21.

In addition, a meander passage 31 in the first stage sequentially connecting the heat absorbing tubes 31 in the first stage from the heat absorbing tube 31 of #11 positioned at the outermost side of the one side in the Y-axis direction to the heat absorbing tube 31 of #16 positioned at the outermost side of the other side in the Y-axis direction is constituted by the six heat absorbing tubes 31 in the first stage and a connecting portion 321 for the first stage sequentially connecting the heat absorbing tubes 31 in the first stage. A meander passage 32 in the second stage sequentially connecting the heat absorbing tubes 31 from the heat absorbing tube 31 of #21 positioned at the outermost side of the one side in the Y-axis direction to the heat absorbing tube of #25 positioned at the outermost side of the other side in the Y-axis direction is constituted by the five heat absorbing tubes 31 in the second stage and a connecting portion 322 for the second stage sequentially connecting the heat absorbing tubes 31 in the second stage.

In this connection, the connecting portion 321 for the first stage is constituted by three U-shaped tubes 321*a* and two U-shaped tubes 321*b*. The three U-shaped tubes 321*a* connect the heat absorbing tubes 31, 31 of #11 and #12, the heat absorbing tubes 31, 31 of #13 and #14, and the heat absorbing tubes 31, 31 of #15 and #16, respectively, which are disposed at an outside of the side plate 11 of the one side in the X-axis direction of the casing 1. The two U-shaped tubes 321*b* connect the heat absorbing tubes 31, 31 of #12 and #13, and the heat absorbing tubes 31, 31 of #14 and #15, respectively, which are disposed at an outside of the side plate 12 of the other side in the X-axis direction of the casing 1. In addition, the connecting portion 322 for the second stage is constituted by two U-shaped tubes 322*a* and two U-shaped tubes 322*b*. The two U-shaped tubes 322*a* connect the heat absorbing tubes 31, 31 of #22 and #23, and the heat absorbing tubes 31, 31 of #24 and #25, respectively, which are disposed at the outside of the side plate 11 of the one side in X-axis direction of the casing 1. The two U-shaped tubes 322*b* connect the heat absorbing tubes 31, 31 of #21 and #22, and the heat absorbing tubes 31, 31 of #23 and #24, respectively, which are disposed at the outside of the side plate 12 of the other side in the X-axis direction of the casing 1.

An inflow tube 33 is connected to the heat absorbing tube 31 of #11 at the upstream end positioned at the outermost side of the one side in the Y-axis direction of the meander passage 31 in the first stage at the outside of the side plate 12 of the other side in the X-axis direction of the casing 1. In addition, the heat absorbing tube 31 of #16 at the downstream end positioned at the outermost side of the other side in the Y-axis direction of the meander passage 31 in the first stage is connected to the heat absorbing tube 31 of #25 at the upstream end positioned at the outermost side of the other side in the Y-axis direction of the meander passage 32 in the second passage at the outside of the side plate 12 of the other side in the X-axis direction of the casing 1 through an intermediate connecting portion $\mathbf{32}_{12}$ consisting of a U-shaped tube, allowing the fluid to be heated to flow from the meander passage $\mathbf{3}_1$ in the first stage to the meander passage $\mathbf{3}_2$ in the second stage. Further, an outflow side joint 34 having an outflow port 34*a* at an end portion thereof is connected to the heat absorbing tube 31 of #21 at the downstream end positioned at the outermost side of the one side in the Y-axis direction of the meander passage $\mathbf{3}_2$ in the second stage at the outside of the side plate 11 of the one side in the X-axis direction of the casing 1. Thus, the connecting portion 32 which sequentially connects all of the heat absorbing tubes 31 in series is made up of the connecting portion $\mathbf{32}_1$ for the first stage, the connecting portion $\mathbf{32}_2$ for the second stage, and the intermediate connecting portion $\mathbf{32}_{12}$.

Referring to FIG. 3, three cooling passages $\mathbf{35}_4$, $\mathbf{35}_8$, $\mathbf{35}_{12}$ of a fourth, an eighth, and a twelfth, consisting of a tube, from the upstream side of the flow direction of the combustion gas in sequence are disposed at an inner side of a portion of the side plate 13 of the one side in the Y-axis direction of the casing 1, which is positioned at a more upstream side of the flow direction of the combustion gas than each heat absorbing fin 2, so as to come into contact with the side plate 13. Three cooling passages $\mathbf{35}_2$, $\mathbf{35}_6$, $\mathbf{35}_{10}$ of a second, a sixth, and a tenth, consisting of a tube, from the upstream side of the flow direction of the combustion gas in sequence are disposed at an inside of a portion of the side plate 14 of the other side in the Y-axis direction of the casing 1, which is positioned at the more upstream side of the flow direction of the combustion gas than each heat absorbing fin 2, so as to come into contact with the side plate 14. In addition, as shown in FIGS. 1, 4, a third cooling passage $\mathbf{35}_3$ connecting the second cooling passage $\mathbf{35}_2$ and the fourth cooling passage $\mathbf{35}_4$, a seventh cooling passage $\mathbf{35}_7$ connecting the sixth cooling passage $\mathbf{35}_6$ and the eighth cooling passage $\mathbf{35}_8$, and an eleventh cooling passage $\mathbf{35}_{11}$ connecting the tenth cooling passage $\mathbf{35}_{10}$ and the twelfth cooling passage $\mathbf{35}_{12}$ are provided at a portion of the side plate 11 of the one side in the X-axis direction of the casing 1, which is positioned at the more upstream side in the flow direction of the combustion gas than each heat absorbing fin 2. Further, as shown in FIGS. 2, 4, a first cooling passage $\mathbf{35}_1$ which is connected to the second cooling passage 352 and at an end portion of which an inflow port $35_{1a}$ in which the fluid to be heated flows from the sub heat exchanger is provided, a fifth cooling passage $35_5$ connecting the fourth cooling passage $35_4$ and the sixth cooling passage $35_6$, and a ninth cooling passage 359 connecting the eighth cooling passage $35_8$ and the tenth cooling passage $35_{10}$ are provided at a portion of the side plate 12 of the other side in the X-axis direction of the casing 1, which is positioned at the more upstream side in the flow direction of the combustion gas than each heat absorbing fin 2. The heat absorbing tube 31 of #11 at the upstream side of the meander passage $3_1$ in the first stage is connected to the twelfth cooling passage $35_{12}$ through the inflow tube 33. Therefore, the fluid to be heated flows in the heat absorbing tube 31 of #11 at the upstream end of the meander passage $3_1$ in the first stage from the inflow port $35_1$a through the first to the twelfth passages $35_1$-$35_{12}$. Thus, each of the side plates 11-14 of the casing 1 is allowed to be cooled by the fluid to be heated flowing in the first to the twelfth cooling passages $35_1$-$35_{12}$.

Meanwhile, each of the third, seventh, and eleventh cooling passages 353, 357, 3511, and each of the first, fifth, and ninth cooling passages $35_1$, $35_5$, $35_9$ are constituted by recesses extending inward in the X-axis direction and formed at each of the side plates 11, 12, and covers 351 mounted on an outer surface of each of the side plates 11, 12 to cover the recesses, respectively. In addition, a plurality of holes 141 into which ignition electrodes, flame rods, or the like are inserted are formed in the side plate 14 of the other side in the Y-axis direction of the casing 1.

Incidentally, when the heat absorbing tubes 31 thermally expand in the X-axis direction as the longitudinal direction thereof, the side plates 11, 12 of each side in the X-axis direction of the casing 1, through which the heat absorbing tubes 31 pierce and on which the heat absorbing tubes 31 are brazed, are pressed in the X-axis direction. In the heat exchanger A of the embodiment, temperature difference between the heat absorbing tube 31 of #11 at the upstream end of the meander passage $3_1$ in the first stage and the heat absorbing tube 31 of #21 at the downstream end of the meander passage $3_2$ in the second stage becomes the largest, and the two heat absorbing tubes 31, 31 of #11 and #21 are positioned at the outermost side of the one side in the Y-axis direction, respectively. Therefore, when a distance between the two heat absorbing tubes 31, 31 of #11 and #21 is short, a large stress acts on the side plates 11, 12 of each side in the X-axis direction of the casing 1 due to difference in the amount of heat expansion between these heat absorbing tubes 31, 31 of #11 and #21. As a result, cracks appear in the side plates 11, 12 due to repeated effects of the stress.

Figure 5:
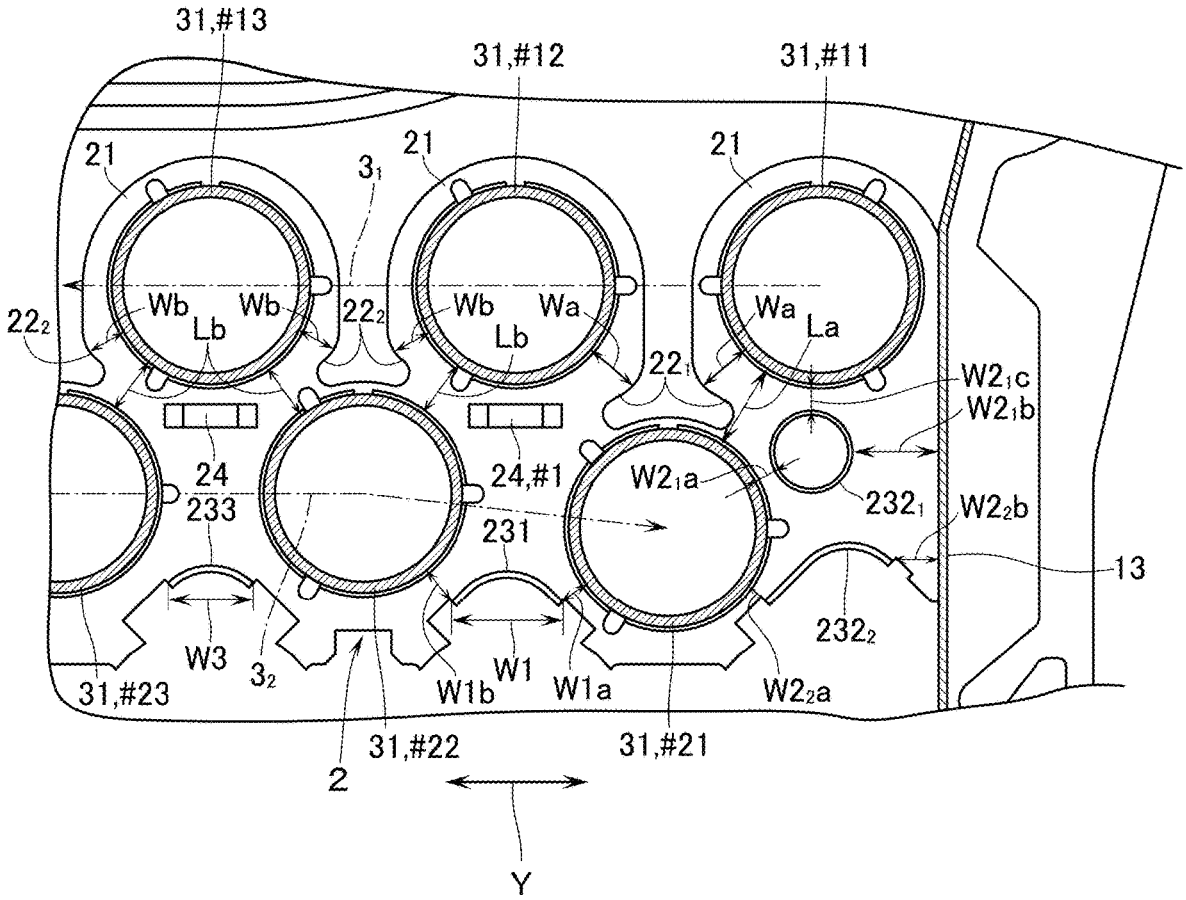
FIG. 5 is an enlarged view of one portion of FIG. 3.
Figure 6:
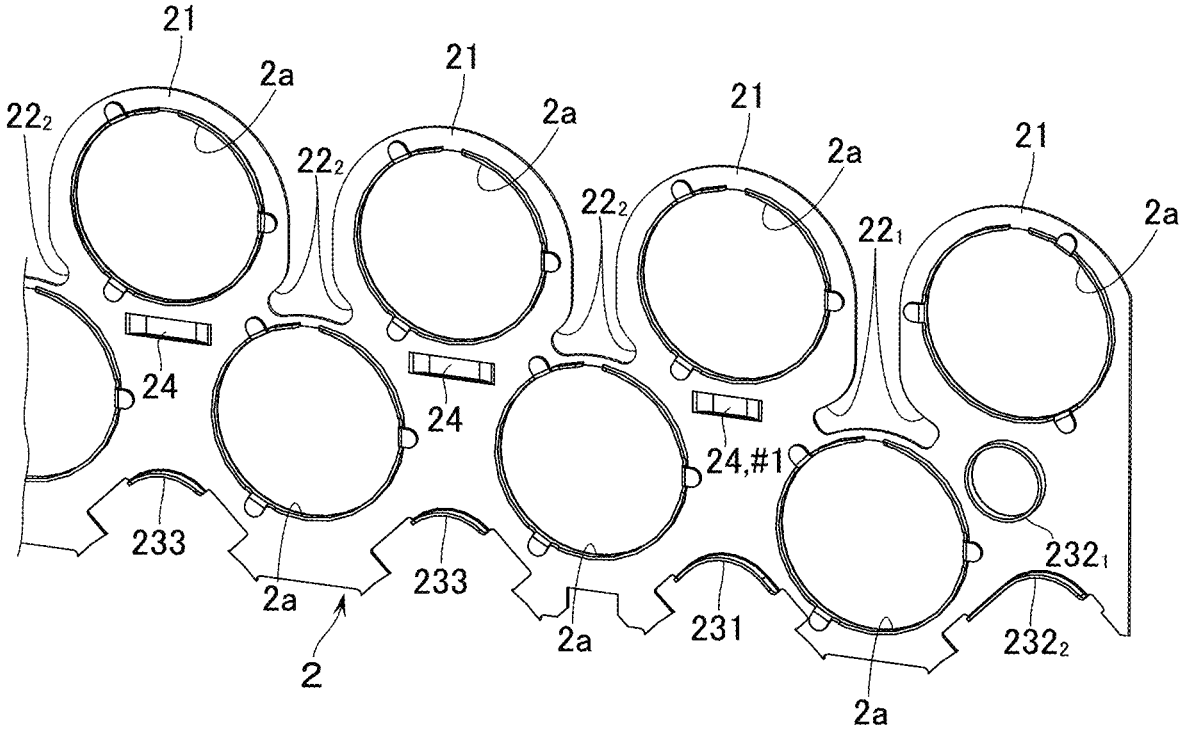
FIG. 6 is an enlarged perspective view of a major portion of each heat absorbing fin provided with the heat exchanger of the embodiment.

Then, in the embodiment, as specified in FIGS. 5, 6, notches are provided with each heat absorbing fin 2 at portions positioned at the more upstream side in the flow direction of the combustion gas than each heat absorbing tube 31 of the meander passage $3_2$ in the second stage. In particular, the notches are provided at each heat absorbing fin 2 by making the notches positioned at base side edge portions of each swelling portion 21 positioned at the more upstream side in the flow direction of the combustion gas than each heat absorbing tube 31 of the meander passage $3_2$ in the second. Then, the notches corresponding to the heat absorbing tube 31 of #21 at the downstream end of the meander passage $3_2$ in the second stage are defined as first notches $22_1$, the notches corresponding to each heat absorbing tube 31 other than the heat absorbing tube 31 of #21 at the downstream end of the meander passage $3_2$ in the second stage are defined as second notches $22_2$, and the first notches $22_1$ are formed larger than the second notches $22_2$.

According to this, the heat transfer to the heat absorbing tube 31 of #21, of which the temperature becomes the highest, at the downstream end of the meander passage $3_2$ in the second stage through each heat absorbing fin 2 can be made to reduce by the larger first notches $22_1$. Therefore, the temperature difference between the two heat absorbing tubes 31, 31 of #11 and #21 is made to decrease, the stress acting on the side plates 11, 12 of each side in the X-axis direction of the casing 1 can be reduced, and durability can be improved.

In addition, in the embodiment, a width Wa of a portion of each heat absorbing fin 2 between the heat absorbing tube 31 of #11 at the upstream end of the meander passage $3_1$ in the first stage and the first notch $22_1$ formed at a side edge portion of the other side in the Y-axis direction of a base of the swelling portion 21 through which such heat absorbing tube 31 of #11 pierces is made wider than widths Wb of portions of each heat absorbing fin 2 between each second notch $22_2$ and such each heat absorbing tube 31 other than the heat absorbing tube 31 of #11 at the upstream end of the meander passage $3_1$ in the first stage as is adjacent to each second notch $22_2$ at the upstream side in the flow direction of the combustion gas. According to this, the heat transfer to the heat absorbing tube 31 of #11 at the upstream end of the meander passage 31 in the first stage through each heat absorbing fin 2 is promoted, and temperature of the combustion gas directed to the heat absorbing tube 31 of #21 at the downstream end of the meander passage 32 in the second stage, which is positioned at the downstream side in the flow direction of the combustion gas with respect to the heat absorbing tube 31 of #11, is lowered. Therefore, the heat transfer from the combustion gas to the heat absorbing tube 31 of #21 can be reduced. As a result, the temperature difference between the two heat absorbing tubes 31, 31 of #11 and #21 is made to decrease more, and the stress acting on the side plates 11, 12 of each side in the X-axis direction of the casing 1 can be reduced.

Meanwhile, the first notch $22_1$ is formed not only at a side edge portion of the other side in the Y-axis direction of the base of the swelling portion 21 through which the heat absorbing tube 31 of #11 at the upstream end of the meander passage $3_1$ in the first stage pierces but also at the side edge portion of the one side in the Y-axis direction of the base of the swelling portion 21 through which the heat absorbing tube 31 of #12 adjacent to the heat absorbing tube 31 of #11 pierces. Then, the portion of each heat absorbing fin 2 between the heat absorbing tube 31 of #12 and the first notch $22_1$ is also made the same width Wa as the portion of each heat absorbing fin 2 between the heat absorbing tube 31 of #11 at the upstream end of the meander passage $3_1$ in the first stage and the first notch 221.

Further, in the embodiment, a distance La between the heat absorbing tube 31 of #11 at the upstream end of the meander passage $3_1$ in the first stage and the heat absorbing tube 31 of #21 at the downstream end of the meander passage $3_2$ in the second stage is made longer than a respective distance Lb between each heat absorbing tube $3_1$ other than the heat absorbing tube 31 of #11 at the upstream end of the meander passage $3_1$ in the first stage and such each heat absorbing tube 31 other than the heat absorbing tube 31 of #21 at the downstream end of the meander passage $3_2$ in the second stage as is the closest to each heat absorbing tube 31 other than the heat absorbing tube 31 of #11 at the upstream end of the meander passage $3_1$ in the first stage. According to this, the stress acting on the side plates 11, 12 of each side in the X-axis direction of the casing 1 due to the difference in the amount of the heat expansion between the two heat absorbing tubes 31, 31 of #11 and #21, between which the temperature difference is the largest, can be reduced by the longer distance La between the two heat absorbing tubes 31, 31 of #11 and #21.

In addition, in the embodiment, as shown in FIG. 3, a ventilation resistant portion 23 is provided to suppress the combustion gas from being directed to the heat absorbing tube 31 of #21 at the downstream end of the meander passage $\mathbf{3}_2$ in the second stage. According to this, it is difficult for the combustion gas to flow around the heat absorbing tube 31 of #21 of which the temperature becomes the highest, and the heat transfer from the combustion gas to such heat absorbing tube 31 of #21 can be made to be reduced. Therefore, the temperature difference between the two heat absorbing tubes 31, 31 of #11 and #21 is made to decrease more, and the stress acting on the side plates 11, 12 of each side in the X-axis direction of the casing 1 can be reduced.

Next, referring to FIGS. 5, 6, the ventilation resistant portion 23 will be particularly explained. In FIG. 6, a symbol "2*a*" represents a burring process hole through which each heat absorbing tube 31 pierces. A first protruding piece portion 231, upper and lower second protruding piece portions $\mathbf{232}_1$, $\mathbf{232}_2$, and a third protruding piece portion 233 are provided at each heat absorbing fin 2 as constituent elements of the ventilation resistant portion 23. The first protruding piece portion 231 is made to be positioned at the more downstream side in the flow direction of the combustion gas than the meander passage 31 in the first stage and between the heat absorbing tube 31 of #21 at the downstream end of the meander passage $\mathbf{3}_2$ in the second stage and the heat absorbing tube 31 of #22 of the meander passage $\mathbf{3}_2$ in the second stage adjacent to the heat absorbing tube 31 of #21 at the downstream end of the meander passage 32 in the second stage, and protrudes in the X-axis direction. The upper and lower second protruding piece portions $\mathbf{232}_1$, $\mathbf{232}_2$ protruding in the X-axis direction are made to be positioned at the more downstream side in the flow direction of the combustion gas than the meander passage 31 in the first stage and between the heat absorbing tube 31 of #21 at the downstream end of the meander passage $\mathbf{3}_2$ in the second stage and the side plate 13 of the one side in the Y-axis direction of the casing 1. The third protruding piece portion 233 protruding in the X-axis direction is made to be positioned between any two of the heat absorbing tubes 31, 31 which are adjacent to each other in the Y-axis direction and are other than the heat absorbing tube 31 of #21 at the downstream end of the meander passage $\mathbf{3}_2$ in the second stage.

Here, a width W1*a* of a minimum portion of a clearance between the heat absorbing tube 31 of #21 at the downstream end of the meander passage $\mathbf{3}_2$ in the second stage and the first protruding piece portion 231 is made narrower than a width W1*b* of a minimum portion of a clearance between the heat absorbing tube 31 of #22 of the meander passage $\mathbf{3}_2$ in the second stage and the first protruding piece portion 231. According to this, the combustion gas flows in a larger amount in the clearance between the heat absorbing tube 31 of #22 of the meander passage $\mathbf{3}_2$ in the second stage and the first protruding piece portion 231, which is wider than that between the heat absorbing tube 31 of #21 at the downstream end of the meander passage $\mathbf{3}_2$ in the second stage and the first protruding piece portion 231. Therefore, the combustion gas can be suppressed from being directed to the heat absorbing tube 31 of #21.

In addition, widths $\mathbf{W2}_1$a, $\mathbf{W2}_2$a of minimum portions of clearances between the heat absorbing tube 31 of #21 at the downstream end of the meander passage $\mathbf{3}_2$ in the second stage and the upper and lower second protruding piece portions 2321, 2322 are made narrower than widths $\mathbf{W2}_1$b, $\mathbf{W2}_2$b of minimum portions of clearances between the side plate 13 of the one side in the Y-axis direction of the casing 1 and the upper and lower second protruding piece portions $\mathbf{232}_1$, $\mathbf{232}_2$, respectively. According to this, the combustion gas flows in the large amount to the clearances between the side plate 13 of the one side in the Y-axis direction of the casing 1 and each of the second protruding piece portions $\mathbf{232}_1$, $\mathbf{232}_2$, which are wider than those between the heat absorbing tube 31 of #21 of the meander passage 32 in the second stage and the second protruding piece portions $\mathbf{232}_1$, $\mathbf{232}_2$. Therefore, the combustion gas can be suppressed from being directed to the heat absorbing tube 31 of #21.

Meanwhile, the upper second protruding piece portion $\mathbf{232}_1$ has a cylindrical shape. A width $\mathbf{W2}_1$c of a minimum portion of a clearance between the upper second protruding piece portion $\mathbf{232}_1$ and the heat absorbing tube 31 of #11 at the upstream end of the meander passage $\mathbf{3}_1$ in the first stage is made wider than the width $\mathbf{W2}_1$a of the minimum portion of the clearance between the upper second protruding piece portion $\mathbf{232}_1$ and the heat absorbing tube 31 of #21 at the downstream end of the meander passage $\mathbf{3}_2$ in the second stage so that the combustion gas flows in the larger amount in the clearance between the upper second protruding piece portion $\mathbf{232}_1$ and the heat absorbing tube 31 of #11.

In addition, a Y-axis direction width W1 of the first protruding piece portion 231 is made wider than a Y-axis direction width W3 of the third protruding piece portion 233 so that the ventilation resistance given by the first protruding piece portion 231 is made larger than that given by the third protruding piece portion 233. According to this, the combustion gas flows in the larger amount between any two of the heat absorbing tubes 31, 31 adjacent to each other in the Y-axis direction, except the heat absorbing tube 31 at the downstream end of the meander passage 32 in the second stage, between which the third protruding piece portion 233 by which the given ventilation resistance is small exists. Therefore, the combustion gas can be suppressed from being directed to the heat absorbing tube 31 of #21 of the meander passage 32 in the second stage. In this connection, a protruding length in the X-axis direction of the first protruding piece portion 231 is made longer than that of the third protruding piece portion 233, whereby it is also possible to make the ventilation resistance given by the first protruding piece portion 231 larger than that given by the third protruding piece portion 233.

Further, in the embodiment, in order for each heat absorbing fin 2 to efficiently absorb heat from the combustion gas, bridge-shaped convex portions being longitudinal in the Y-axis direction 24 are provided at each heat absorbing fin 2. Each bridge-shaped convex portion 24 is made to be positioned at the more downstream side of the flow direction of the combustion gas than the meander passage 31 in the first stage and between any two of the heat absorbing tubes 31, 31 adjacent to each other in the Y-axis direction of the meander passage $\mathbf{3}_2$ in the second stage, and protrudes in an X-axis opposite direction to each of the above-mentioned protruding piece portions 231-233 so as to form tunnel-like passages through which the combustion gas passes. Here, a Y-axis direction center of the bridge-shaped convex portion 24 of #1 provided between the heat absorbing tube 31 of #21 at the downstream end of the meander passage 32 in the second stage and the heat absorbing tube 31 of #22 adjacent to the heat absorbing tube 31 of #21 at the downstream end of the meander passage 32 in the second stage at the other side in the Y-axis direction is more one-sided to the other side of the Y-axis direction than a Y-axis direction center between the two heat absorbing tubes 31, 31 of #21 and #22 of the meander passage $3_2$ in the second stage. According to this, the bridge-shaped convex portion 24 of #1 is made away from the heat absorbing tube 31 of #21 at the downstream end of the meander passage $3_2$ in the second stage. Therefore, the heat transfer to the heat absorbing tube 31 of #21 through the bridge-shaped convex portion 24 of #1 is reduced. As a result, the temperature difference between the heat absorbing tube 31 of #11 at the upstream end of the meander passage $3_1$ in the first stage and the heat absorbing tube 31 of #21 at the downstream end of the meander passage $3_2$ in the second stage can be made to decrease, which contributes to reducing the stress acting on the side plates 11, 12 of each side in the X-axis direction of the casing 1.

In addition, in the embodiment, as shown in FIG. 3, the exhaust port 41 of the exhaust gas gathering portion 4 is provided at a deviated portion of the other side in the Y-axis direction of the exhaust gas gathering portion 4. According to this, the combustion gas which flows toward the exhaust port 41 does not gather in the vicinity of the heat absorbing tube 31 of #21 of which the temperature becomes the highest at the downstream end of the meander passage 32 in the second stage, which is positioned at the outermost side of the one side in the Y-axis direction, and the heat transfer from the combustion gas to the heat absorbing tube 31 of #21 can be reduced. Therefore, the temperature difference between the two heat absorbing tubes 31, 31 of #11 and #21 is made to decrease more, and the stress acting on the side plates 11, 12 of each side in the X-axis direction can be more reduced.

Though the embodiment of the invention is explained with reference to the drawings, the invention is not limited to the embodiment. For example, though the distance Lb between each heat absorbing tube 31 other than the heat absorbing tube 31 of #11 at the upstream end of the meander passage $3_1$ in the first stage and such each heat absorbing tube 31 other than the heat absorbing tube 31 of #21 at the downstream end of the meander passage $3_2$ in the second stage as is the closest to each heat absorbing tube 31 other than the heat absorbing tube 31 at the upstream end of the meander passage $3_1$ in the first stage is made constant, and only the distance La between the heat absorbing tube 31 of #11 at the upstream end of the meander passage 31 in the first stage and the heat absorbing tube 31 of #21 at the downstream end of the meander passage 32 in the second stage is made longer than the distance Lb, it may be possible that the distance Lb between each heat absorbing tube 31 other than the heat absorbing tube 31 of #11 at the upstream end of the meander passage $3_1$ in the first stage and such each heat absorbing tube 31 other than the heat absorbing tube 31 of #21 at the downstream end of the meander passage $3_2$ in the second stage as is the closest to each heat absorbing tube 31 other than the heat absorbing tube 31 of #11 at the upstream end of the meander passage $3_1$ in the first stage is made to gradually increase from the other side in the Y-axis direction to the one side in the Y-axis direction.

Explanation of Symbols

A Heat exchanger
1 Casing
11, 12 Side plates of each side in X-axis direction of casing
2 Heat absorbing fin
$22_1$ First notches
$22_2$ Second notches
23 Ventilation resistant portion
$3_1$ Meander passage in first stage
$3_2$ Meander passage in second passage
31 Heat absorbing tube
32 Connecting portion
$32_1$ Connecting portion for first stage
$32_2$ Connecting portion for second stage
4 Exhaust gas gathering portion
41 Exhaust port
Wa Width of portion of each heat absorbing fin between heat absorbing tube at upstream end of meander passage in first stage and first notch
Wb Widths of portions of each heat absorbing fin between each second notch and such heat absorbing tube other than heat absorbing tube at upstream end of meander passage in first stage as is adjacent to each second notch at upstream side of flow direction of combustion gas
La Distance between heat absorbing tube at upstream end of meander passage in first stage and heat absorbing tube at downstream end of meander passage in second stage
Lb Respective distance between each heat absorbing tube other than heat absorbing tube at upstream end of meander passage in first stage and such each heat absorbing tube other than heat absorbing tube at downstream end of meander passage in second stage as is the closest to each heat absorbing tube other than heat absorbing tube at upstream end of meander passage in first stage

What is claimed is:

1. A heat exchanger heated by a combustion gas, comprising, a box-shaped casing an inside of which the combustion gas flows in; on a premise that two orthogonal directions crossing a flow direction of the combustion gas in the casing are defined as an X-axis direction and a Y-axis direction, respectively; a plurality of heat absorbing fins stacked and arranged in the X-axis direction in the casing; a plurality of heat absorbing tubes piercing through the heat absorbing fins and side plates of both sides in the X-axis direction, and an inside of which a fluid to be heated flows in; and a connecting portion connecting the heat absorbing tubes in series at outsides of the side plates of both sides in the X-axis direction of the casing, wherein the heat absorbing tubes are divided into two stages and arranged in the flow direction of the combustion gas, a meander passage connecting a plurality of the heat absorbing tubes in each stage from an outermost side of one side in the Y-axis direction to an outermost side of the other side in the Y-axis direction is constituted by a plurality of the heat absorbing tubes in each stage and the connecting portion for each stage, the meander passage is provided in a first stage of an upstream side in the flow direction of the combustion gas and the meander passage is provided in a second stage of a downstream side in the flow direction of the combustion gas, the heat absorbing tube at an upstream end and the heat absorbing tube at a downstream end of the meander passage in the first stage are positioned at the outermost side of the one side in the Y-axis direction and at the outermost side of the other side in the Y-axis direction, respectively, and the heat absorbing tube at the downstream end of the meander passage in the first stage and the heat absorbing tube at the upstream end, which is positioned at the outermost side of the other side in the Y-axis direction, of the meander passage in the second passage are connected, allowing the fluid to be heated to flow from the meander passage in the first stage to the meander passage in the second stage, wherein:

notches are provided over each heat absorbing tube of the meander passage in the second stage, and projecting in the upstream direction of the combustion gas flow between each heat absorbing tube of the meander passage in the first stage wherein each notch confined within a diameter of the heat absorbing tubes, the notches corresponding to the heat absorbing tube at the downstream end, which is positioned at the outermost side of the one side in the Y-axis direction of the meander passage in the second stage, are defined as first notches, the notches corresponding to each heat absorbing tube other than the heat absorbing tube at the downstream end of the meander passage of the second passage are defined as second notches, and the first notches are formed larger than the second notches, and wherein a closest width of a portion of each heat absorbing fin in a radial direction of the heat absorbing tube between the heat absorbing tube at the upstream end of the meander passage in the first stage and the first notch is wider than a closest width of each portion of the heat absorbing fin in the radial direction of the heat absorbing tube between each second notch and the closest heat absorbing tube other than the heat absorbing tube at the upstream end of the meander passage in the first stage that is adjacent to the corresponding second notch at the upstream side in the flow direction of the combustion gas.

2. The heat exchanger as claimed in claim 1, wherein the closest width according to claim 1 promotes heat transfer to the heat absorbing tube at the upstream end of the meander passage in the first stage through the heat absorbing fins, thereby lowering the temperature of the combustion gas directed to the heat absorbing tube at the downstream end of the meander passage in the second stage, reducing the temperature difference between the upstream-end and downstream-end heat absorbing tubes, and suppressing thermal stress acting on the side plates of the casing.

3. The heat exchanger as claimed in claim 1, wherein a distance between the heat absorbing tube at the upstream end positioned at the outermost side of the one side in the Y-axis direction of the meander passage in the first stage and the heat absorbing tube at the downstream end positioned at the outermost side of the one side in the Y-axis direction of the meander passage in the second stage is longer than a respective distance between each heat absorbing tube other than the heat absorbing tube at the upstream end of the meander passage in the first stage and each heat absorbing tube other than the heat absorbing tube at the downstream end of the meander passage in the second stage that is-closest to the each heat absorbing tube other than the heat absorbing tube at the upstream end of the meander passage in the first stage, whereby stress acting on side plates of both sides in the X-axis direction of the casing is reduced.

4. The heat exchanger as claimed in claim 1, wherein a ventilation resistant portion which suppresses the combustion gas from being directed to the heat absorbing tube at the downstream end of the meander passage in the second stage is provided.

5. The heat exchanger as claimed in claim 1, wherein an exhaust gas gathering portion covering an opening at the downstream end in the flow direction of the combustion gas of the casing is provided, and an exhaust port for discharging the combustion gas is opened at the exhaust gas gathering portion, wherein:

the exhaust port is provided at a deviated portion of the other side in the Y-axis direction of the exhaust gas gathering portion.

* * * * *